United States Patent [19]

Parsons, Jr. et al.

[11] 4,281,252

[45] Jul. 28, 1981

[54] COUPLING APPARATUS FOR PORTABLE RADIOGRAPHY SYSTEMS

[75] Inventors: George W. Parsons, Jr., North Reading; Riccardo A. Drainoni, Woburn, both of Mass.

[73] Assignee: Technical Operations, Inc., Boston, Mass.

[21] Appl. No.: 88,464

[22] Filed: Oct. 26, 1979

Related U.S. Application Data

[63] Continuation of Ser. No. 964,078, Nov. 27, 1978, abandoned.

[51] Int. Cl.[3] ..... G21F 5/02

[52] U.S. Cl. ..... 250/497; 74/501 R; 250/493

[58] Field of Search ..... 250/497, 496; 74/501

[56] References Cited

U.S. PATENT DOCUMENTS

| | | | |
|---|---|---|---|
| 2,976,423 | 3/1961 | Prest | 250/497 |
| 3,147,383 | 9/1964 | Prest | 250/497 |
| 3,593,594 | 7/1971 | Perry | 250/497 |

*Primary Examiner*—Harold A. Dixon

*Attorney, Agent, or Firm*—Wolf, Greenfield & Sacks

[57] ABSTRACT

A coupling apparatus for separably connecting cable controls to the storage unit of a radiographic system, having a coupler component fixed to the storage unit and a separable component fitted to the control cable. The latter fits into an aperture in the fixed component, where it can be locked against removal. The fixed component locks the radioactive material leader for safe storage when the control cable is disconnected. Connection of the control cable permits the operator to release the lock on the leader. The act of releasing that lock establishes an interlock which prevents removal of the separable component from the fixed component.

17 Claims, 24 Drawing Figures

FIG. 1A PRIOR ART STORED POSITION

FIG. 1B PRIOR ART SOURCE IN TRANSIT

FIG. 1C PRIOR ART SOURCE AT RADIOGRAPHIC SITE

COUPLING APPARATUS FOR PORTABLE RADIOGRAPHY SYSTEMS

This application is a continuation-in-part of U.S. application Ser. No. 964,078 filed Nov. 27, 1978, now abandoned.

THE PRIOR ART

As is shown in FIG. 1 of the accompanying drawings, systems for the handling of radioactive material 1 involve the provision of a storage unit 2 having a mass 3 of radiation-shielding material with a passage 4 through it, in which the radioactive material can be safely stored when not in use, as is shown in FIG. 1 at A, and from which the radioactive material can be moved to a use location, as for making a radiograph, as is shown in FIG. 1 at C. Typically, the radioactive material 1 is connected to drive means comprising a flexible cable 5 in a guide tube 6. The guide tube is generally provided in three essentially equal-lengths 6A, 6B and 6C, each of which can be disconnectibly coupled to the storage unit 2. Under control of a reel and crank arrangement 7 the drive cable 5 pushes the radioactive material out of the passage 4 and through the third guide tube 6C to a snout 8 located where the radiograph is to be made, as shown in FIG. 1 at B and C. The portion of drive cable 5 in the second guide tube 6B supplies the cable necessary to fill the first and third guide tubes 6A and 6C when a radiograph is being made. A disconnectible coupler 9 is fitted in the drive cable 5 so that when the radioactive material 1 is in the stored position the drive cable can be parted outside the storage unit for uncoupling the cable 5 and the guide tubes 6A and 6B from the storage unit. The part of drive cable 5 between the coupler 9 and the radioactive material 1 is known as the leader 11, and the coupling apparatus 10 between the guide tubes 6A and 6B and the storage unit 2 generally contains means to lock the leader against movement through the passage 4 when the drive means are uncoupled and removed. U.S. Pat. No. 3,147,383 and No. 3,593,594 describe prior systems in which these features are found. The present invention provides improved coupling apparatus, such as couplers 10 in such systems, to provide a simpler and less costly coupling apparatus without sacrificing reliability or safety.

GENERAL NATURE OF THE INVENTION

In the present invention coupling apparatus is provided for the first guide tube 6A, to the end of which a tubular shaped separable coupler component is fitted, and another coupler component fixed to the storage unit at one end of the passage 4 has a tubular aperture for receiving the separable component endwise, and means for releasably locking the separable component in the tubular aperture. The coupler components are aligned with the passage 4 so that the separable component will guide the drive cable 5 to the passage 4 when locked in the tubular aperture of the fixed component, which incorporates interlocking members for locking and releasing the leader 11, and the separable component, as desired. A latch pin in the fixed component retains the leader 11 locked by these interlocking members until the latch pin is released by insertion of the separable component in the tubular aperture. The interlocking members are then operable to release the leader 11 for movement through the passage 4 and to lock the separable component to the fixed component. The design of the separable component is such that the drive cable coupler 9 must be safely engaged in order for the separable component to be fitted into the tubular aperture on the fixed component and release the latch therein. When the interlocking members are operated to release the leader 11 they lock the separable component to the fixed component thereby preventing decoupling of the separable component until the leader is returned to its locked position and locked in that position, thereby safely storing the radioactive material 1 in the storage unit 2. In one embodiment of the invention, the interlocking members are slides held in respective slideways in the fixed component and arranged for movement transverse to the passage 4. In another embodiment, a single slide operable by a rotatable cam ring is arranged for such transverse movement.

BRIEF DESCRIPTION OF THE DRAWINGS

FIGS. 2–12, inclusive, illustrate a first embodiment of the invention, wherein:

FIG. 2 is an end view of a fixed component of a coupling apparatus according to the invention;

FIG. 3 is a side view partially in section of a separable component of the coupling apparatus of the invention;

FIG. 4 is an exploded view of the coupling means including both of the components of FIGS. 2 and 3;

FIG. 5 is a section on line 5—5 of a part of FIG. 4;

FIG. 6 is a section on line 6—6 of another part in FIG. 4;

FIG. 7 is an enlarged view of a third part in FIG. 4;

FIG. 8 is a side view of a lockable portion of a leader for a source of radioactive material;

FIG. 9 is a side-sectional view on line 9—9 of the fixed component of the coupling means shown in FIG. 2, with the lockable portion of the leader fixed in it, to hold a radioactive source in the stored position;

FIG. 10 is a partial cross-section taken along a line 10—10 in FIG. 2 showing a detail of the cooperation of both components of the coupling apparatus for releasing the lockable portion of the drive means;

FIG. 11 is a side section on the same view as FIG. 9 through the two components of the coupling apparatus assembled and released from locking positions to provide a passage for the drive means; FIGS. 13–21, illustrate a second embodiment of the invention, wherein:

FIG. 13 is an end view of the fixed component;

FIG. 14 is a section on line 14—14 of FIG. 13;

FIG. 15 is a section on line 15—15 of FIG. 13;

FIG. 16 is an exploded view of the coupling means;

FIG. 17 is a plan view with two orthogonally-related sections through the cam ring shown in FIG. 16;

FIG. 18 is a partial section showing the fixed and separable components locked together;

FIG. 19 is a section through the separable component showing the coupler retracted;

FIG. 20 is a section through the separable component showing the coupler extended; and FIG. 21 is a section through a lock plug.

DETAILED DESCRIPTION OF THE DRAWINGS

Figure 1:
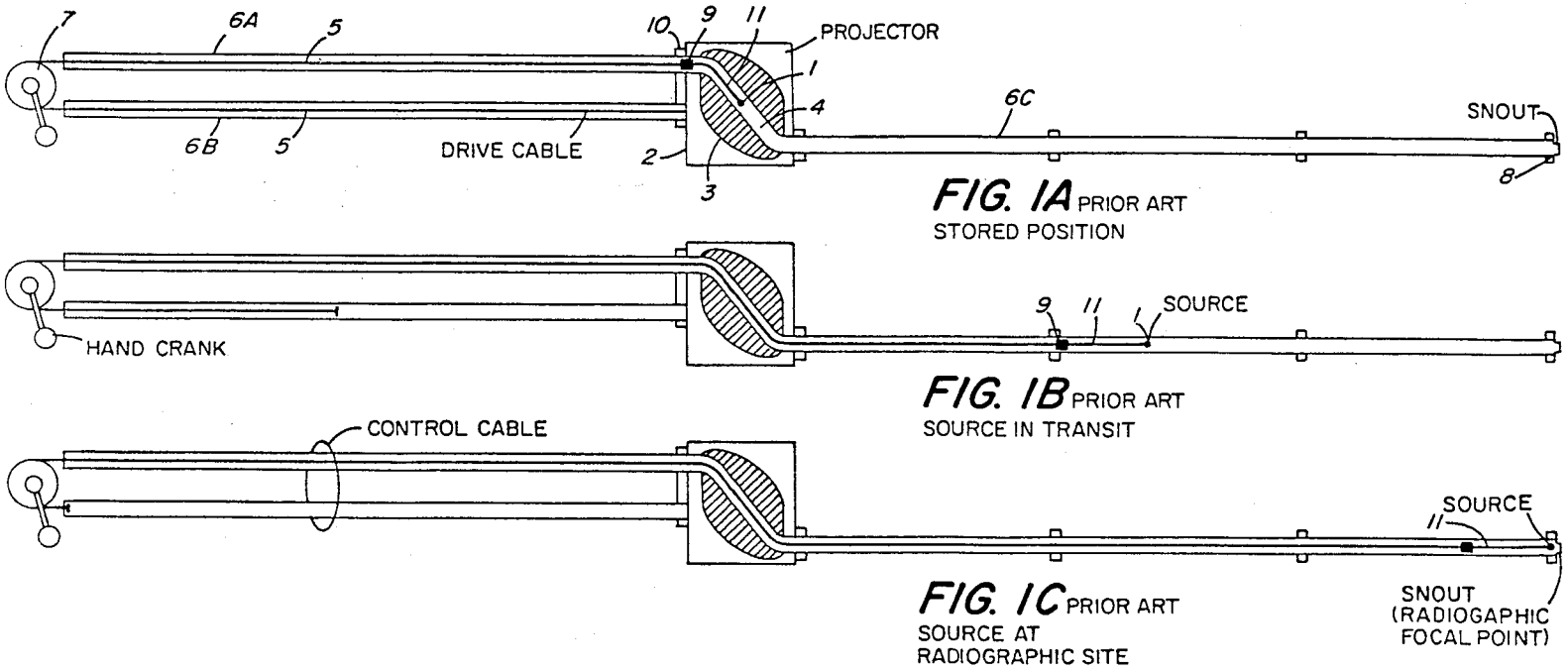
FIGS. 1A, 1B, 1C illustrates a known system, described above, to which the invention is applicable.

FIGS. 1A, 1B and 1C illustrate a prior art system with the radioactive source displaced at various positions.

The following description of the illustrated coupling apparatus should be read with reference to FIGS. 2–7, inclusive, of the accompanying drawings, initial reference being made to FIGS. 3–7, inclusive. The fixed component is comprised essentially of a mounting plate 20, a base block 22 with first and second slideways 24, 26, respectively, formed in it, first and second interlocking members 28, 30, respectively, a latch pin 32, a cover block 34 in which the tubular aperture 36 is formed and, optionally, a key-lock 38 fitted in the cover block. The separable component is comprised essentially of a tubular body 40 intended to fit telescopically into the tubular aperture 36 and a tubular slide member 42 within the tubular body, this component being illustrated in detail in FIG. 3. The fixed component is assembled on the mounting plate 20, and in use the plate 20 is attached to a storage unit such as unit 2 in FIG. 1. Such attachment is illustrated in the above-referenced United States Patents.

Figures 4, 5, 6, 7:
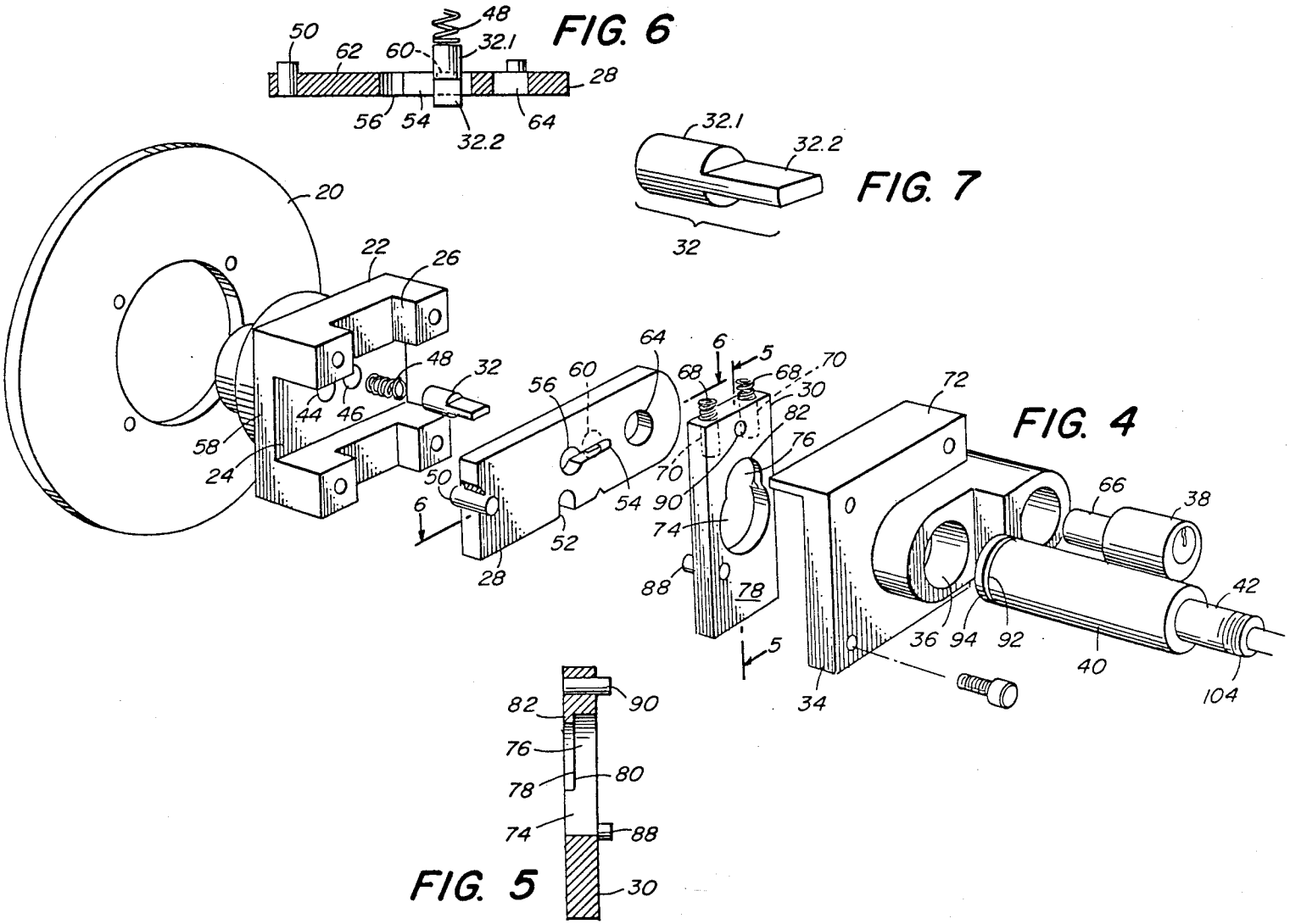

The base block 22 has a main bore 44 through it which aligns with the passage 4, or equivalent, when the fixed component is attached to a storage unit. The main bore extends from the bottom wall 46 of the first slideway 24. Alongside the main bore 24 in this bottom wall is a hole 46 extending only part way into the base block, for receiving a compressible spring 48 and the round base portion 32.1 of the latch pin 32. The forward portion 32.2 of the latch pin is flattened, as is best illustrated in FIG. 7. The first interlocking member 28 is a first rectangular slide block which fits slidably in the first slideway 24 so that it can be moved transversely to the main bore 44. A stop pin 50 is fitted into one end of the first slide block 28 and extends back toward the mounting plate 20. A notch 52 is provided in one long side of this slide block, for an interlock function to be described below. A slot 54 through the slide block 28 terminates at one end in a round slide bore 56 which is located to register with the main bore 44 in the base block when the slide block is moved to one of its operating positions; in that position the stop pin 50 meets a wall part 58 of the base block 22. A shallow depression 60 in the rear wall 62 of the slide block 28 receives the forward end of the round base portion 32.1 of the latch pin when the slide block is moved in the slideway 24 to a second of its operating positions. The shallow depression 60 is indicated in dotted lines in FIG. 4, and in section in FIG. 6. The flattened forward portion 32.2 of the latch pin extends forward through the slot 54, into the second interlocking member 30, as will be more fully described below. When the first slide block 28 is latched by engaging the latch pin 32 in the depression 60, the slide bore 56 is out of register with the main bore 44 in the base block 22, and the slot 54 overlies the main bore 44, as appears in FIG. 2 and in FIG. 9, to be described. A further hole 64 through the slide block 28 in the end region remote from the stop pin 50 aligns with the bolt 66 of the lock 38 when the first slide block 28 is latched, enabling a user to lock the first slide block in the latched position, and thereby to prevent unauthorized use of the system incorporating this coupling apparatus.

Figure 2:
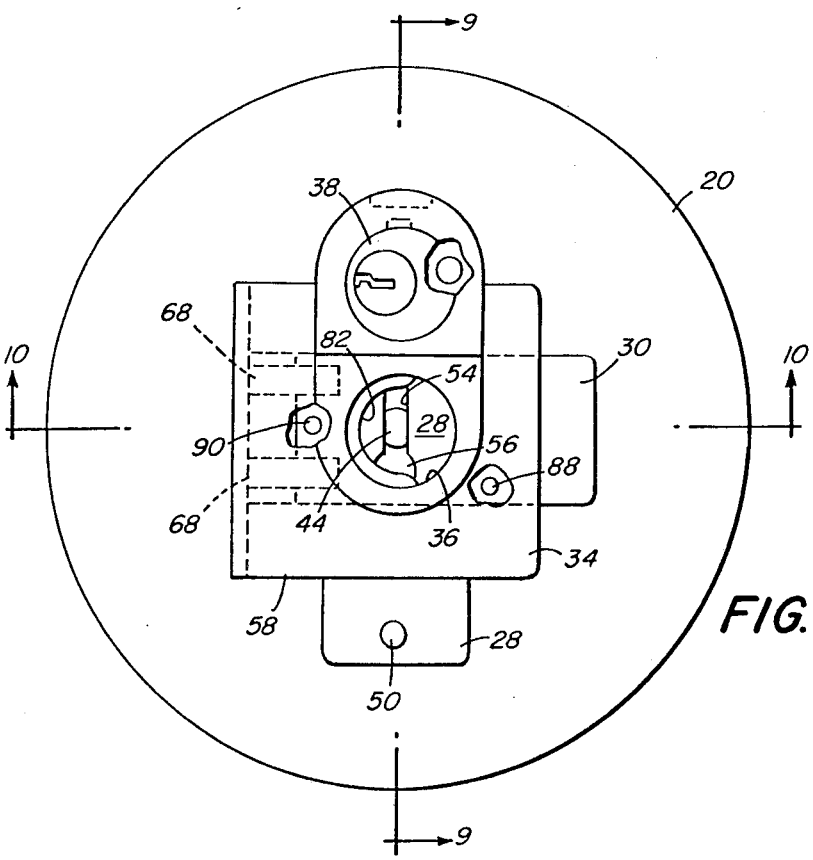

The second interlocking member 30 is a second rectangular slide block which fits slidably in the second slideway 26 overlying the first slide block 28, and is movable transversely to the main bore 44 in the base block 22. Conveniently, the second slide block 30 moves in a path transverse also to the path in which the first slide block 28 moves, thus providing that each slide block is available for manipulation in a unique path, minimizing the potential for confusion in operating the apparatus, as appears in FIG. 2. A pair of springs 68, 68 are received at one end of each in holes 70, 70, respectively, in one end of the second slide block, and are retained at the other end of each under an overlying shelf 72 extending from the cover block 34 back toward the base block 22. These springs urge the second slide block 30 downwardly, as seen in FIG. 4. A passage hole 74 having a diameter similar to that of the tubular aperture 36 is provided through the second slide block 30, and a second hole 76 through the same block is provided adjacent to the passage hole 74, so that the areas encompassed within these respective holes partly overlap. The second hole 76 is smaller in diameter than the passage hole, as seen from the face 78 of the second slide block confronting the cover block 34. The second hole is, however, counter-sunk in the opposite face 80 so that as seen from the opposite face the second hole 76 has essentially the same diameter as the passage hole 74, providing an arc-shaped flange 82 in the second hole, along the inner boundary remote from the passage hole 74 and extending toward the passage hole. A first stop pin 88 in the second slide block extends from a location below the passage hole back toward the first slide block 28, in a position from which it can enter the notch 52 when the first slide block is in the latched position. A second stop pin 90 in the second slide block extends from a location above the second hole 76 back over the top long edge (as seen in FIG. 2) of the first slide block 28. In the uncoupled state, with the separable component 40 absent, as seen in FIG. 2, the springs 68 urge the second slide block 30 downward to a position in which the second stop pin 90 comes to rest on the first slide block; in that position the arcuate flange 82 is visible through the tubular aperture 36, as appears in FIG. 2.

Figure 3:
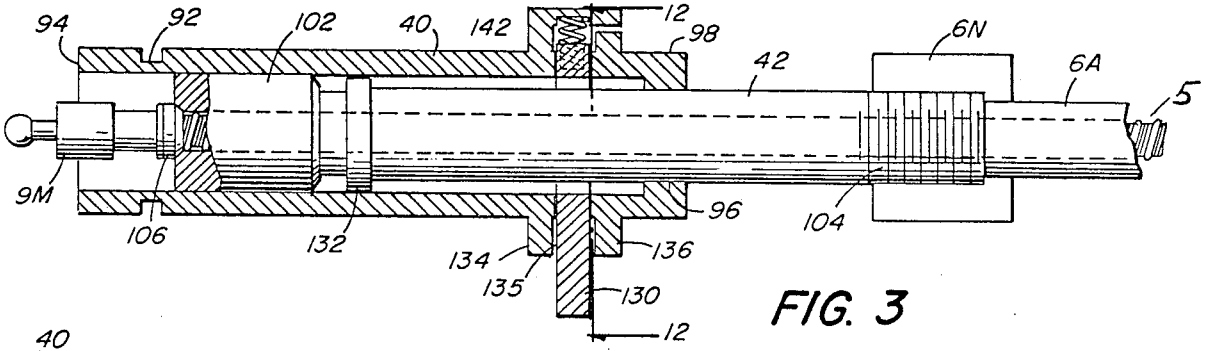

The tubular body 40 of the separable component has an annular groove 92 near its remote extremity 94, as is shown also in FIG. 3. An inwardly-directed flange 96 terminates the inner extremity 98, providing a short passage of lesser diameter than the passage through the major part of the tubular body 40. The tubular slide member 42 has an enlarged portion 102 (FIG. 3) at its inner end, the outer diameter of which is slightly smaller than the inner diameter of the major portion of the tubular body 40, but larger than the inner diameter of the flange 96, so that the slide member 42 can pass through the outer extremity 94 and slide within the tubular body 40, but cannot pass out of the tubular body 40 through the inner extremity 98. The inner extremity 104 of the slide member 42 is externally threaded for use in attaching a guide tube, such as the guide tube 6A in FIG. 1. When a guide tube is connected, the nipple 6N prevents withdrawal of the slide member 42 through the remote extremity 94 of the tubular body 40.

A drive cable 5 can pass through the tubular slide member 42, terminating in a male part 9M of a typical cable connector. This connector part has a tapered flange 106 the diameter of which is larger than the diameter of the inner passageway through the tubular slide member 42, so that the connector part 9M cannot be withdrawn through the inner passageway. The male connector part 9M can, however, be extended out of the separable component 40, 42, as far as may be convenient for joining the cable connector 9.

Figure 8:
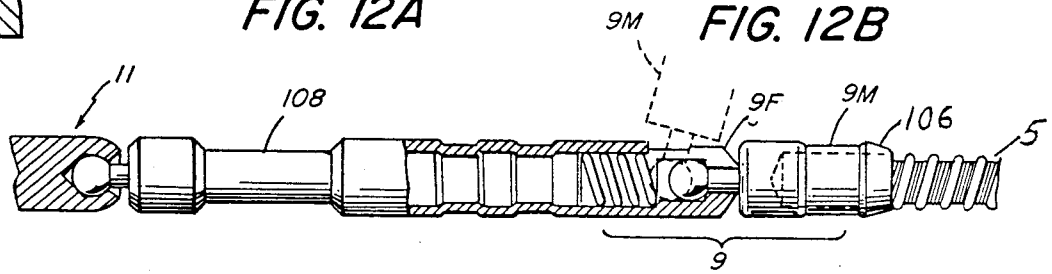

Referring now to FIG. 8, a portion at the end of a leader 11 is shown which includes the female part 9F of the cable connector 9. A mode of joining the cable connector 9 is illustrated in dashed-line, but since the cable connector, per se, forms no part of the present invention, it will not be further described. The invention can be practiced with any suitable cable connector; U.S. Pat. No. 3,237,977 shows another connector that can be used. A distance along the leader 11 from the connector 9, a store-lock portion 108 of reduced diameter is provided for engagement in the slot 54 when the first slide block 28 is in the latched position. The entire leader part illustrated in FIG. 8, from the female coupler part 9F to the store-lock portion 108 can fit through the bore 56 in the first slide block 28, but only the store-lock portion 108 can fit in the slot 54.

Figure 9:
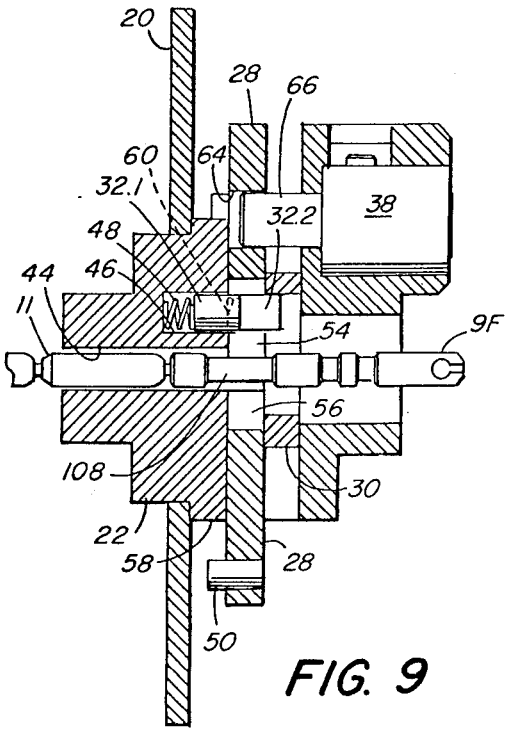

The distance from the store-lock portion 108 to the female connector part 9F is such that when the store-lock portion 108 is engaged in the slot 54, the female connector part 9F will stick out of the tubular passage 36, and will be held firmly fixed in position, so that the male connector part 9M can be connected to it, as is shown in FIG. 9. In that figure the first slide block is in its latched position described above, with the slide bore 56 out of register with the main bore 44, and the lock bolt 66 is shown engaged in the lock hole 64. The length of leader 11 is such that when the store-lock portion 108 is locked in the slot 54 a capsule of radio-active material 1 attached to the leader (not shown in FIG. 9) will be located in a safe storage position in the storage unit 2, as is illustrated in FIG. 1 at A.

Figure 10:
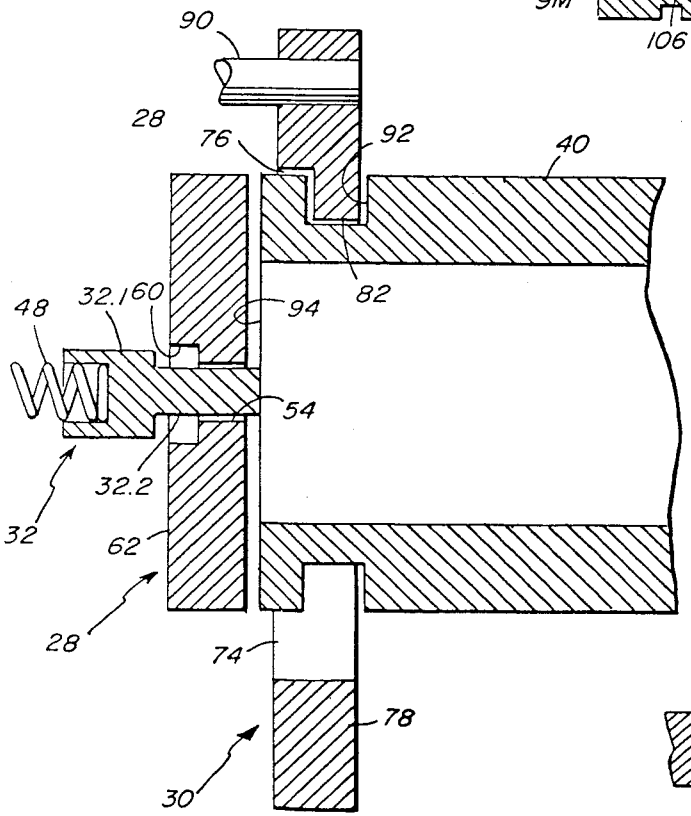

Referring now to FIGS. 2 and 10, if the second slide block 30 is pushed to the left as seen in FIG. 2, the first stop pin 88 enters notch 52 in the first slide block 28, the arcuate flange 82 is moved out of the tubular aperture 36 and the separable component tubular body 40 can be passed through the tubular aperture and into the passage hole 74, where the inner extremity 94 comes into contact with the confronting extremity of the flattened forward portion 32.2 of the latch pin 32 and pushes the round base portion 32.1 out of the shallow depression 60 in the rear wall 62 of the first slide block 28. Upon release of pushing force on the second slide block 30 the springs 68 return it to the position shown in FIGS. 2 and 10, with the arcuate flange 82 engaged in the annual groove 92 in the tubular body 40, thereby retaining the tubular body 40 locked to the fixed component of the coupling apparatus.

Figure 11:
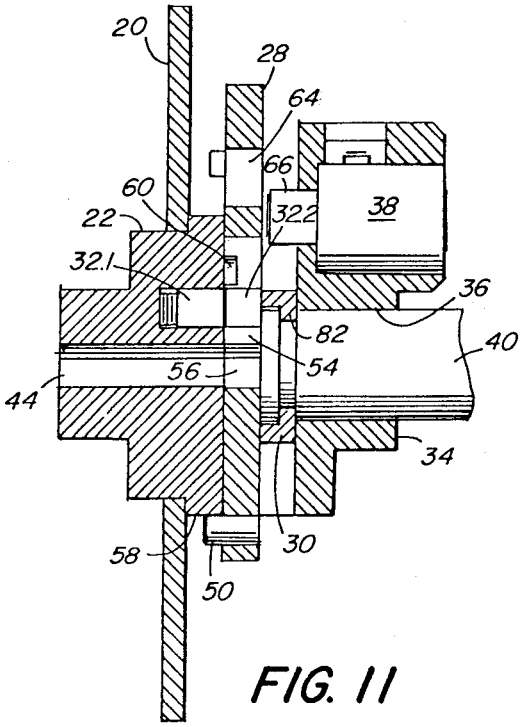

Referring now to FIG. 11, which shows the coupling apparatus operated as illustrated in FIG. 10, the latch pin 32 is now disengaged from the first slide block 28, which is now both unlocked and unlatched, and has been moved to the operating position placing the slide bore 56 in register with the main bore 44. The stop pin 50 has moved to the wall part 58 of the base block 22. In this operating position of the first slide block 28, the notch 52 is out of register with the first stop pin 88 on the second slide block 30, and the first slide block 28 is effective to prevent the second slide block 30 from releasing the tubular body 40 as long as the slide bore 56 is in register with the main bore 44. The cable 5 can now be moved through the coupling apparatus and the system can be operated as is illustrated in FIG. 1 at B and C. When the cable 5 (not shown in FIG. 11) is in the slide bore 56, the first slide block 28 cannot be moved toward the latched position, because the diameter of the cable is larger than the width of the slot 54.

The reverse operation is equally simple and reliable. The cable 5 is operated to return the radioactive material 1 to the storage position, and simultaneously to locate the store-lock portion 108 of the leader 11 in the slide bore 56. The first slide block 28 is then manipulated, from the operating position shown in FIG. 11 (downward in the figure) to the latched position shown in FIG. 9, locking the leader 11 in position in the storage unit 2. The notch 52 is now in register with the first stop pin 50 of the second slide block 30, which is now manipulated (to the left in FIG. 2) to release the separable component tubular body 40 from the arcuate flange 82. The separable component parts 40, 42 can now be moved away from the fixed component assembly, exposing the cable connector 9 and enabling the male portion 9M to be separated from the female portion 9F. The stop pin 32 engages the depression 60 to latch the first slide block 28 in the stored position, and the key lock 38 (if present) can now be operated to engage the bolt 66 in the lock hole 64, so as to prevent unauthorized use of the system.

When the cable connector 9 is being joined, as shown for example in FIG. 8, it is desirable that the tubular body 40 be drawn back over the inner tubular body 42, toward the nipple 6N, so as to expose the male connector part 9M. When after the cable connector has been joined the outer tubular body 40 is locked to the fixed component of the coupler, as shown in FIG. 10, the outer body 40 is slid over the inner member 42 into the tubular aperture 36, so that the inner member 42 sticks out of the outer body 42. If during use of the system the inner member 42 is allowed to move into the outer member 40, when after use it is desired to return the radioactive material 1 to to the stored position (FIG. 1 at A) the cable connector 9 will meet the enlarged portion 102 of the inner slide member 42 at a location so close to the first slide block 28 that the store-lock portion 108 of the leader 11 will not be located in the round slide bore 56. It would then be necessary to withdraw the inner member 42 from the outer body 40 in order to seat the radiographic material 1 safely in the stored position and disconnect the coupler and cable connector components.

Figure 12B:
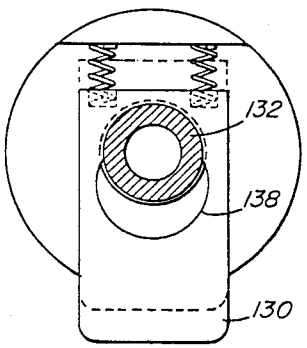
FIGS. 12A and 12B are sections on line 12—12 of FIG. 3.
Figure 12A:
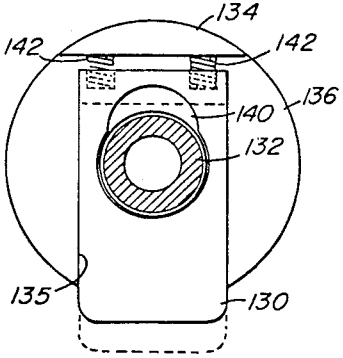

To minimize such a possibility, the separable component is preferably fitted with a third slide block 130 which cooperates with a collar 132 on the inner tubular member 42 in a manner similar to the second slide block 30 and the annular groove 92, as is illustrated in FIGS. 3, 12A and 12B. A housing 134, 136 affixed to the outer tubular body 40, shown schematically in FIG. 3, provides a guideway 135 for the third slide block 130, in which the third slide block can be moved transverse to the tubular axis. Like the second slide block 30, the third slide block 130 has a pair of overlapping bores 138, 140 through it, the larger bore 138 being large enough to pass the collar 132, and the smaller bore 140 being too small to pass the collar 132. A pair of springs 142 urge the third slide block 130 downward (in the drawings) so that the smaller bore 140 is urged to be normally in the passage within the outer tubular body 40, as shown in FIG. 12B. The third slide block 130 is pushed upward, as shown in FIG. 12A, to enable the collar 132 to be moved to the flange 96 at the inner extremity 98 of the outer body 40. Upon release the third slide block then moves its smaller bore 140 into place behind the collar 132, latching the inner tubular member 42 into the fully-extended position. In the case where a connection is to be made, this latch is released and the relative positions of the tubular parts 40, 42 that is shown in FIG. 3 is established.

The following description of the illustrated coupling apparatus should be read with reference to FIGS. 13–21, inclusive, of the accompanying drawings. The fixed component is comprised essentially of a mounting plate 120, a base block 122 with a first slideway 124 formed in it, a first interlocking member 128, a latch pin 132, a cam ring 126, a cover block 134 in which the tubular aperture 136 is formed and, optionally, a key-lock fitted in a block 130. The separable component is comprised essentially of a tubular body 140 intended to fit telescopically into the tubular aperture 136, this component being illustrated in longitudinal section in FIGS. 19 and 20. The fixed component is assembled on the mounting plate 120 with bolts 142 (only one being shown in FIG. 16) and in use the plate 120 is attached to a storage unit such as unit 2 in FIG. 1. Such attachment is illustrated in the above-referenced United States Patents.

Figure 16:
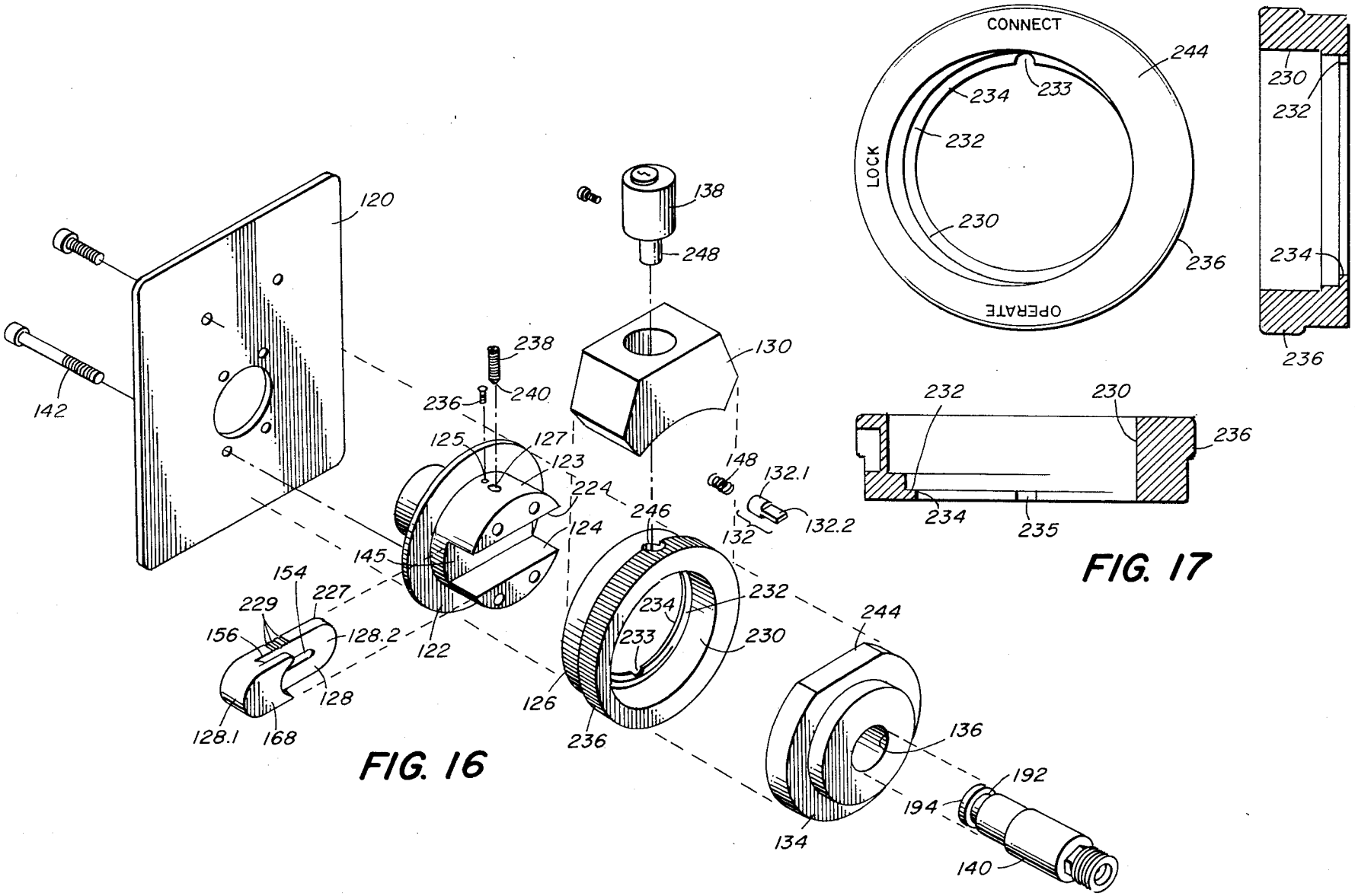

The base block 122 has a main bore 144 through it which aligns with the passage 4, or equivalent, when the fixed component is attached to a storage unit. The main bore extends from the bottom wall 145 of the slideway 124. Alongside the main bore 144 in this bottom wall is a hole 146 extending only part way into the base block, for receiving a compressible spring 148 and the round base portion 132.1 of the latch pin 132. The forward portion 132.2 of the latch pin is flattened, as is best illustrated in FIG. 16. The interlocking member 128 is a generally rectangular slide block which fits slideably in the slideway 124 so that it can be moved transversely to the main bore 144. A slot 154 through the slide block 128 terminates at one end in a round slide bore 156 which is located to register with the main bore 144 in the base block when the slide block is moved to one of its operating positions; in that position the latch pin 132 is moved into its hole 146 compressing the spring 148, as will be described. A shallow depression 160 in the rear wall 162 of the slide block 128 (FIG. 18) receives the forward end of the round base portion 132.1 of the latch pin when the slide block is moved in the slideway 124 to a second of its operating positions. The shallow depression 160 is indicated in dotted lines in FIG. 18. The flattened forward portion 132.2 of the latch pin then extends forward through the slot 154, into the space between the slide block 128 and the cover block 134, as will be more fully described below. When the slide block 128 is latched by engaging the latch pin 132 in the depression 160, the slide bore 156 is out of register with the main bore 144 in the base block 122, and the slot 154 overlies the main bore 144, as appears in FIG. 13.

The cam ring 126 operates the slide block 128 in the slideway 124 in motion transversely to the main bore 144 in the base block 122. The cam ring is basically a tubular body having within it an offcenter race 230 embracing the rounded ends 128.1 and 128.2 of the slide block 128 at diametrically-opposite contact lines. Behind the race 230, nearer to the base block 122, the cam ring has a flange 232 with a centrally-disposed round aperture 234 fitted on the forward round portion 123 of the base block. A pin nail 236 in a hole 125 in the forward round portion 123 retains the flange 232 on the base block; gaps 233 in the flange 232 are for use to fit the cam ring to the base block during assembly of the fixed component.

Figure 13:
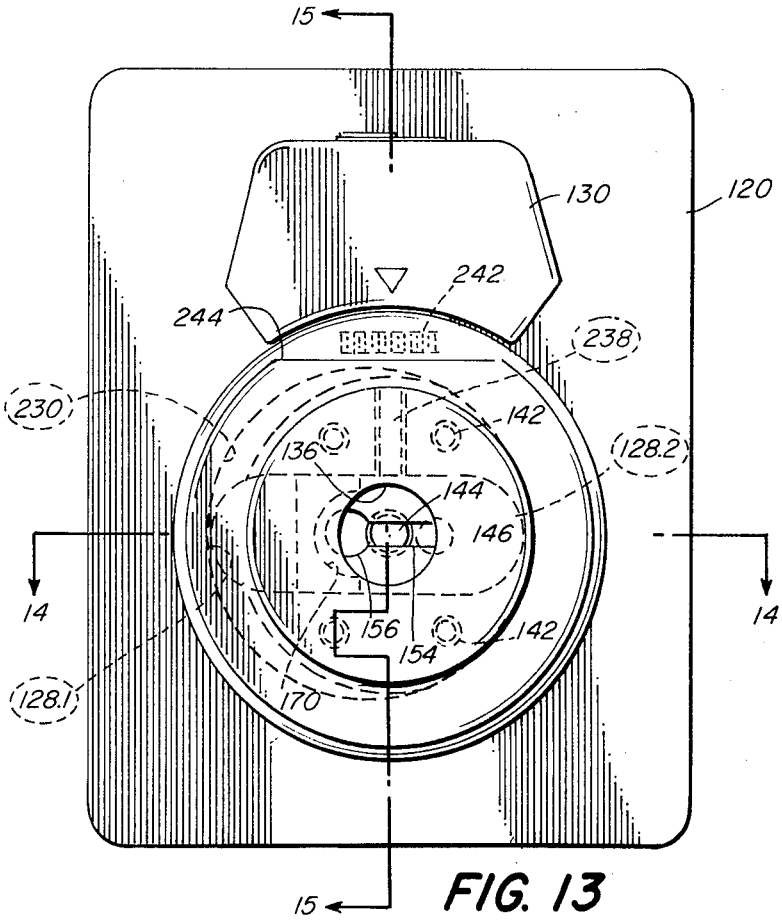
Figure 14:
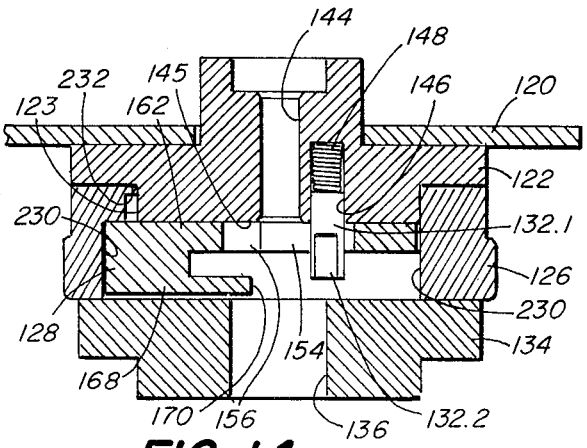
Figure 15:
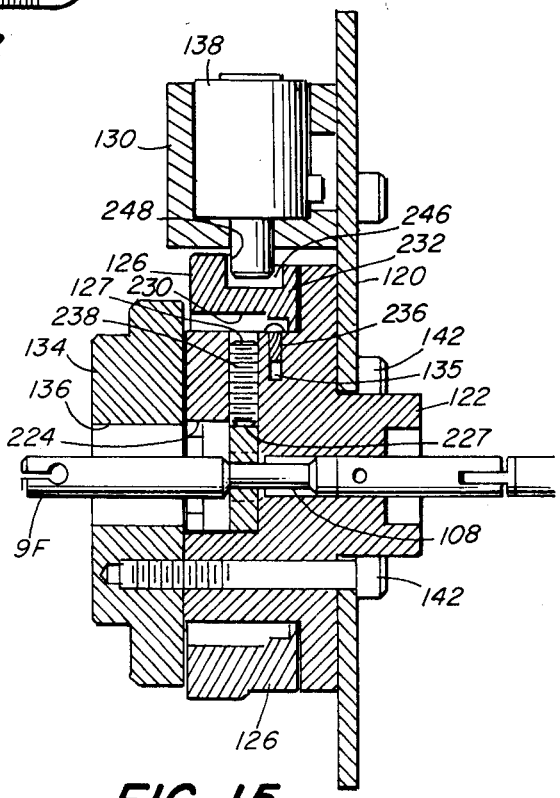

The outer circumferential surface 236 of the cam ring is knurled to facilitate hand-turning the cam ring on the round surface of the forward round portion 123 of the base block 122. When the cam ring is rotated on the base block the off-center cam race 230 moves the slide block 128 in the slideway 124, if the latch pin 132 is out of the depression 160. The slide block has a series of notches 229 in the longitudinal surface 227 confronting the upper inner surface 224 of the slideway 124 (FIGS. 15, 16). A set screw 238 in a threaded hole 127, and fitted with a spring loaded ball 240 at its inner end, engages the ball in one of the notches at each of three positions of the slide block along the slideway 124. Each of those positions corresponds to one of the legends "CONNECT", "LOCK" and "OPERATE" which are marked at 90-degree intervals on the forward face 244 of the cam ring. The cover block 134 has a chordal segment removed leaving a flat surface 244 over which one only of these legends 242 is visible, depending on the angular position of the cam ring 126 relative to the cover block, as is represented in FIG. 13.

A lock hole 246 opening into the cam ring from its outer periphery is provided to receive the bolt 248 of the lock 138 when the cam ring 126 is turned to bring the lock hole into register with the lock bolt. In this position the legend "LOCK" is visible over the flat surface 244 of the cover block 134.

Figure 18:
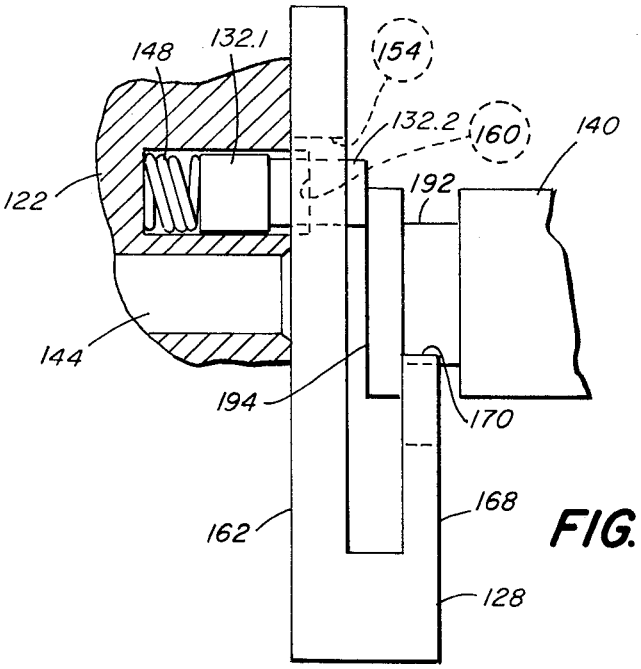

The slide block 128 has an interlock arm 168 for the separable component 140, providing an arc-shaped flange 170 which can be moved into and out of the tubular aperture 136 as the slide block is moved back and forth in the slideway 124, so as to engage or release, respectively, the separable component at its annular groove 192 (similarly to the arc-shaped flange 82 and annular groove 92 in the embodiment of FIGS. 2–11, inclusive). This cooperation between the slide block 128 and the separable component 140 is best illustrated in FIG. 18, where the cooperation between the separable component and the latch pin 132 is also illustrated.

The forward portion 132.2 of the latch pin extends through the slot 154. When the base portion 132.1 of the latch pin is seated in the depression 160 in the rear wall 162 of the slide block 128, this is the "CONNECT" position of the coupling apparatus, in which the interlock arm 168 is pulled aside holding the flange 170 out of the tubular aperture 136. The end 194 of the separable component 140, at which the annular groove 192 is located, can then be pushed into the tubular aperture 136, pushing on the forward portion 132.2 of the latch pin and moving the base portion 132.1 out of the depression 160, releasing the slide block 128 so that it can be moved in the slideway to the "OPERATE" position, by turning the cam ring 126 clockwise, approximately one-half turn.

Figure 21:
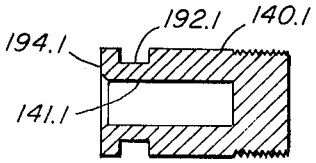

The cam ring has three positions of use, which can be seen in FIGS. 13 and 17, which are, respectively, the "CONNECT" position, the "LOCK" position, and the "OPERATE" position. In the "LOCK" position the cam ring is turned approximately one-quarter turn clockwise (as seen in FIGS. 16 and 17), and the slide block 128 is moved only part-way through the slideway 124 so that the slide bore 156 is not yet in register with the main bore 144, and the store-lock portion 108 of the connector 9 is retained in the slot 154. A lock plug 140.1, shown in FIG. 21, is used to release the latch pin 132 so as to set the cam ring in the "LOCK" position.

The forward end of this plug has an end 194.1 which can push on the forward portion 132.2 of the latch pin, and an annular groove 192.1, of larger diameter than the annular groove 192 in the separable component 140, which receives the arc-shaped flange 170 of the interlock arm 168 but, owing to the size of its diameter, prevents the slide block 128 from being moved to the "OPERATE" position wherein the slide bore 156 would be in register with the main bore. In this position, the key lock 138 can be operated to put its bolt 248 in the lock hole 246. The lock plug 140.1 is retained in the fixed component tubular aperture 136, sheltering the female end 9F of the connector 9 within the bore 141.1. In this condition the storage unit 2 enclosing radioactive material 1 can be shipped or stored without drive means connected to it.

Figure 19:
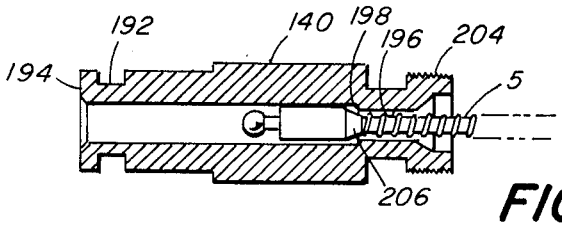
Figure 20:
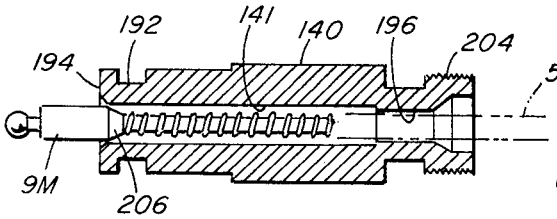

The tubular body 140 of the separable component has an annular groove 192 near its remote extremity 194, as is shown also in FIGS. 13, 19 and 20. An inwardly-directed flange terminates the inner extremity 198, providing a short passage 196 of lesser diameter than the passage through the major part of the tubular body 140. The inner extremity 204 of the tubular body 140 is externally threaded for use in attaching a guide tube, such as the guide tube 6A in FIG. 1. A drive cable 5 can pass through the short passage 198, terminating in a male part 9M of a typical cable connector. This connector part has a tapered flange 206 the diameter of which is larger than the diameter of the short passage 198 so that the connector part 9M cannot be withdrawn through the short passage. The male connector part 9M can, however, be extended out of the separable component 140, as far as may be convenient for joining the cable connector 9. The distance from the remote extremity 194 to the flange 198 is such that the tubular body 140 cannot be inserted through the tubular aperture 136 far enough to release the slide block 128 from the latch pin 132 unless the connector parts 9M and 9F are first connected together.

To change from the "LOCK" position to the "OPERATE" position, it is first necessary to unlock the key lock 138, turn the cam ring 126 to the "CONNECT" position, and remove the lock plug 140.1. This allows the latch pin 132 to latch the slide block 128 against movement, thus holding the female connector part 9F locked in the stored position, where the male part 9M can be joined to it, after which the separable component 140 can be inserted through the tubular aperture 136 to depress the forward portion 132.1 of the latch pin, and the cam ring 126 can be turned to the "OPERATE" position. In that position, the slide block 128 is moved through the slideway 124 to the position in which the slide bore 156 is in register with the main bore 144, and the connector can be moved through the slide block by the drive cable 5. The diameter of the annular groove 192 is smaller than the diameter of the annular groove 192.1 of the lock plug, by an amount which permits this additional movement of the slide block.

We claim:

1. In radiographic apparatus for manipulating a quantity of radioactive material between a stored position and a use position including a capsule of said radioactive material, a storage unit with a passage through it for storing the capsule in the passage and shielding the surrounding environment from the stored radioactive material, manipulating means for location remote from said storage unit, flexible conduit means connectible to said storage unit between one end of said passage and the manipulating means, and flexible elongated drive means movable within said conduit means and said passage for moving said capsule between a stored position and a use position under control of said manipulating means, the improvement comprising: disconnectible coupling means having a first component fixed to said storage unit at said one end of said passage and a second component of tubular shape fixed at one end to an end of said conduit means remote from said manipulating means, said first component having a tubular aperture for receiving said second component endwise therein, and means for releasably locking said second component to said first component, said locking means comprising a first slide member mounted in said first component for movement transverse to said tubular aperture between first and second limits, said first slide member having engagement means which extends into said tubular aperture when said first slide member is at said second limit, and is withdrawn from said tubular aperture when said first slide member is at said first limit, said second component having means to receive said engagement means in said tubular aperture for locking said second component against withdrawal from said tubular aperture when said first slide member is moved toward said second limit.

2. In apparatus according to claim 1, a first slide member mounted in said first component for movement transverse to said tubular aperture between first and second limits, said first slide member having a hole through it which registers with said tubular aperture when said first slide member is at said first limit, said hole being sized to pass said second component when the latter is inserted through said tubular aperture, and means on said first slide member for locking said second component against withdrawal from said tubular aperture when said first slide member is moved toward said second limit to a locking position.

3. Apparatus according to claim 1 including a peripheral groove around said second component near the end remote from said conduit means, for receiving said engagement means in said groove when said first slide member is in said locking position.

4. Apparatus according to claim 2 including a second slide member mounted in said first component for movement transverse to said tubular aperture between first and second limits, latch means for retaining said second slide member in said first limit, said second component when inserted through said tubular aperture being operable to release said latch means.

5. Apparatus according to claim 4 including interlock means on said second slide member operable when said second slide member is moved to said second limit to retain said first slide member in said locking position, whereby said second component cannot be separated from said first component while said second slide member is in its second limit.

6. Apparatus according to claim 5 wherein said capsule is attached to a leader extending at one end into said first component when said capsule is stored in said storage unit, a first drive-means coupling member fixed to said one end, said second slide member having a slot with an aperture through which said first drive means coupling member can pass when said second slide member is in its second limit, and means for interlocking said first drive-means coupling member with said second slide member when said second slide member is in its first limit.

7. Apparatus according to claim 6 including a tubular member slidably fitting within said second component for locating a second drive-means coupling member axially with relation to said second component, said second drive-means coupling member being affixed to an end of said flexible elongate drive means which extends through said tubular member and having restraining means preventing withdrawal of said second drive-means coupling member into said tubular member, so that said second drive-means coupling member can be extended out of said second component by sliding said tubular member out of said second component in a first direction, for giving access to said second drive means coupling member.

8. Apparatus according to claim 7 including interlockable latch means fitted to said second component and said tubular member for releasably latching said tubular member extending out of said storage component in a second direction opposite to said first direction a distance such that said second drive-means coupling member can be drawn within said second component a distance sufficient to locate said first drive-means coupling member in interlocking relation with said second slide member.

9. Apparatus according to claim 1 wherein said capsule is attached to a leader extending at one end into said first component when said capsule is stored in said storage unit, a first drive-means coupling member fixed to said one end, said first slide member having a slot with an aperture through which said first drive means coupling member can pass when said first slide member is in its second limit, and means for interlocking said first drive-means coupling member with said slot when said first slide member is in its first limit.

10. Apparatus according to claim 1 comprising annular cam means mounted on said first component for concentric rotation about the axis of said tubular aperture, means providing a cam surface within said cam means arranged to engage the ends of said first slide member, for moving said first slide member between said first and second limits by rotating said cam means about said axis.

11. Apparatus according to claim 1 including means to latch said first slide member in said first limit, said latch means including a pin extending forward through said first slide means toward said tubular aperture, said second component being so dimensioned that when inserted into said tubular aperture far enough to receive said engagement means it pushes said pin backward to unlatch said first slide member thereby enabling said first slide member to be moved toward said second limit.

12. Apparatus according to claim 10 including means to lock said cam ring in a position in which it holds said first slide member at an intermediate position between said first and second limits.

13. Apparatus according to claim 9 including means to hold said first slide member in a position intermediate said first and second limits with said first drive-means coupling member interlocked in said slot.

14. Apparatus according to claim 9 including means to latch said first slide member in said first limit, said latch means including a latch pin extending forward through said slot toward said tubular aperture, said second component being so dimensioned that when inserted into said tubular aperture far enough to receive said engagement means its remote end pushes said pin backward to unlatch said first slide member thereby enabling said first slide member to be moved toward said second limit.

15. Apparatus according to claim 14 comprising annular cam means mounted on said first component for concentric rotation about the axis of said tubular aperture, means providing a cam surface within said cam means arranged to engage the ends of said first slide member, for moving said first slide member between said first and second limits by rotating said cam means about said axis.

16. Apparatus according to claim 15 including means to lock said cam ring in a position in which it holds said first slide member in a position intermediate said first and second limits with said first drive-means coupling member interlocked in said slot.

17. Apparatus according to claim 14 wherein said second component carries a second drive-means coupling member in a bore opening through said remote end, and within said bore a stop restricting the axial distance said second coupling member can be retracted into said bore, said axial distance being so limited that said drive means coupling members must be connected together before said second component can be inserted into said tubular aperture far enough to unlatch said latch means, said second drive-means coupling member being withdrawable from said bore beyond said remote end to facilitate making connection between said coupling members prior to inserting said second component into said tubular aperture.

* * * * *